US007841121B1

(12) United States Patent
Barrett

(10) Patent No.: US 7,841,121 B1
(45) Date of Patent: Nov. 30, 2010

(54) TAKEDOWN RIFLE

(75) Inventor: David B. Barrett, Liberty, UT (US)

(73) Assignee: Browning, Morgan, UT (US)

( * ) Notice: Subject to any disclaimer, the term of this patent is extended or adjusted under 35 U.S.C. 154(b) by 308 days.

(21) Appl. No.: 11/971,706

(22) Filed: Jan. 9, 2008

(51) Int. Cl.
*F41A 21/48* (2006.01)

(52) U.S. Cl. ..... 42/75.02

(58) Field of Classification Search ..... 42/75.02
See application file for complete search history.

(56) References Cited

U.S. PATENT DOCUMENTS

| | | | | | |
|---|---|---|---|---|---|
| 450,448 | A | * | 4/1891 | Cilley | 42/75.02 |
| 557,360 | A | * | 3/1896 | Burgess | 42/21 |
| 618,033 | A | * | 1/1899 | Hemming | 42/75.02 |
| 1,373,888 | A | * | 4/1921 | Johnson | 42/75.02 |
| 2,447,091 | A | | 8/1948 | Pope | |
| 2,782,688 | A | * | 2/1957 | Leek et al. | 89/199 |
| 3,306,168 | A | | 2/1967 | Blumrick | |
| 3,776,095 | A | | 12/1973 | Atchisson | |
| 3,780,618 | A | | 12/1973 | Sanford | |
| 4,654,993 | A | | 4/1987 | Atchisson | |
| 4,703,826 | A | * | 11/1987 | Byron | 89/188 |
| 5,499,569 | A | | 3/1996 | Schuetz | |
| 5,540,008 | A | * | 7/1996 | Kirnstatter | 42/75.02 |
| 5,678,340 | A | | 10/1997 | Moon | |
| 5,768,815 | A | | 6/1998 | Casull | |
| 5,794,373 | A | | 8/1998 | Moon | |
| 6,739,082 | B2 | * | 5/2004 | Christensen | 42/6 |
| 7,377,066 | B2 | | 5/2008 | Moore | |
| 2005/0235543 | A1 | | 10/2005 | Murello | |

* cited by examiner

*Primary Examiner*—Stephen M Johnson
(74) *Attorney, Agent, or Firm*—Holland & Hart

(57) ABSTRACT

A take-down rifle is described that can be separated into two halves to allow the rifle to be transported, cleaned, etc. easier. The takedown rifle includes a takedown mechanism that is used to couple the two halves of the rifle together. The take-down mechanism may move between a first position where the takedown mechanism holds the two halves together and a second position where the two halves are released. In one embodiment, the takedown mechanism may include a securing member that is selectively moved into and out of a recess in the barrel to hold and release the two halves. The securing member may be moved into and out of the recess with a lever, threaded fastener, or the like.

28 Claims, 6 Drawing Sheets

TAKEDOWN RIFLE

CROSS REFERENCE TO RELATED PATENT APPLICATIONS

U.S. patent application Ser. No. 11/971,690, entitled "Multi-Caliber Bolt for a Firearm," filed on 9 Jan. 2008, is hereby incorporated by reference herein in its entirety (the "Multi-Caliber Bolt Application").

BACKGROUND

Takedown rifles have been available for many years. The term "takedown" generally refers to a type of rifle where the barrel and forearm can be readily connected to and disconnected from the stock and the receiver to permit the rifle to be separated into two pieces or halves. Separating the rifle in this manner makes it easier to transport, clean, and so forth. Unfortunately, conventional takedown rifles have suffered from a number of problems that have hindered more widespread acceptance of these firearms.

One of the most common complaints about takedown rifles is that they are unable to hold zero, or, in other words, they are unable to consistently hit the same spot after the barrel has been removed and reinstalled. The inability of conventional takedown rifles to hold zero can be attributed to a number of factors such as loosening of the connection between the barrel and the receiver over time, the difficulty of returning the barrel to the same position after it has been removed, and the like.

Another common complaint associated with takedown rifles is that they are complicated and difficult to use and/or maintain. Much of this criticism can be traced to the mechanism that is used to allow the takedown rifle to be separated into two halves. Conventional mechanisms have been viewed as being overly complex and subject to failure. The increased complexity has also adversely affected the ability of the rifle to hold zero because even the smallest contaminant in the mechanism can reduce the accuracy of the rifle.

Conventional takedown rifles have threads on both the barrel and the receiver. The threads are interrupted so that the barrel can be inserted straight into the receiver (in the interrupted section where there are no threads) and turned to engage the threads in the barrel with the threads in the receiver. This setup results in a significant amount of stress or force being exerted on the receiver when the rifle is fired. Consequently, the receiver is typically made from steel. Although steel is strong, the overall weight of the receiver is much greater than other firearms where the receiver can be made from lighter materials.

Accordingly, it would be desirable to provide an improved takedown rifle that overcomes one or more of these disadvantages. The mechanism that is used to separate the rifle should be simple and reliable. Also, it would be desirable to create a takedown rifle that is better at holding zero than conventional takedown rifles.

SUMMARY

A number of embodiments of a takedown rifle are described herein. The takedown rifle is capable of being easily separated into two separate parts or pieces to make it easier to transport, store, clean, and so forth. The takedown rifle may be configured to hold zero to within 0.75 to 1.0 inches at 100 yards. Also, the takedown rifle includes an improved mechanism to separate the rifle that is both simple and reliable.

In one embodiment, the takedown rifle comprises a first half that includes a stock coupled to a receiver, a second half that includes a barrel coupled to a forearm, and a takedown mechanism configured to couple the first half and the second half together. The takedown mechanism includes a securing member and is configured to move the securing member into a recess in the barrel to hold the first half and the second half together.

In another embodiment, the takedown rifle comprises a first half that includes a stock coupled to a receiver, a second half that includes a barrel coupled to a forearm, and a lever mechanism configured to couple the first half and the second half together. The lever mechanism moves between a first position where the lever mechanism holds the first half and the second half together and a second position where the first half and the second half are not held together. The amount of force needed to move the lever mechanism from the second position to the first position initially increases, reaches a maximum, and then decreases until the lever mechanism reaches the first position.

In another embodiment, the takedown rifle comprises a stock, a receiver coupled to the stock, a barrel coupled to the receiver with a takedown mechanism, and a forearm coupled to the barrel. The takedown rifle is configured to be separated into two parts by the takedown mechanism. One of the two parts includes the stock and the receiver and the other one of the two parts includes the barrel and the forearm. The takedown mechanism is configured to move between a first position where a securing member is positioned in a recess in the barrel to hold the takedown rifle together and a second position where the securing member is not in the recess to allow the takedown rifle to be separated into the two parts.

The foregoing and other features, utilities, and advantages of the subject matter described herein will be apparent from the following more particular description of certain embodiments as illustrated in the accompanying drawings.

DRAWINGS

DETAILED DESCRIPTION

A number of embodiments of a takedown rifle are described herein. It should be appreciated at the outset that the configuration of various components may be altered in any suitable way to obtain additional embodiments. For example, the takedown rifle is shown in the FIGS. as having a lever action. In other embodiments, however, the takedown rifle may have a bolt action or an automatic action (semi-automatic or fully-automatic). Accordingly, the subject matter recited in the claims is not coextensive with and should not be interpreted to be coextensive with any particular embodiment, feature, or combination of features shown herein. This is true even if only a single embodiment of the particular feature or combination of features is illustrated and described herein.

Figure 1:
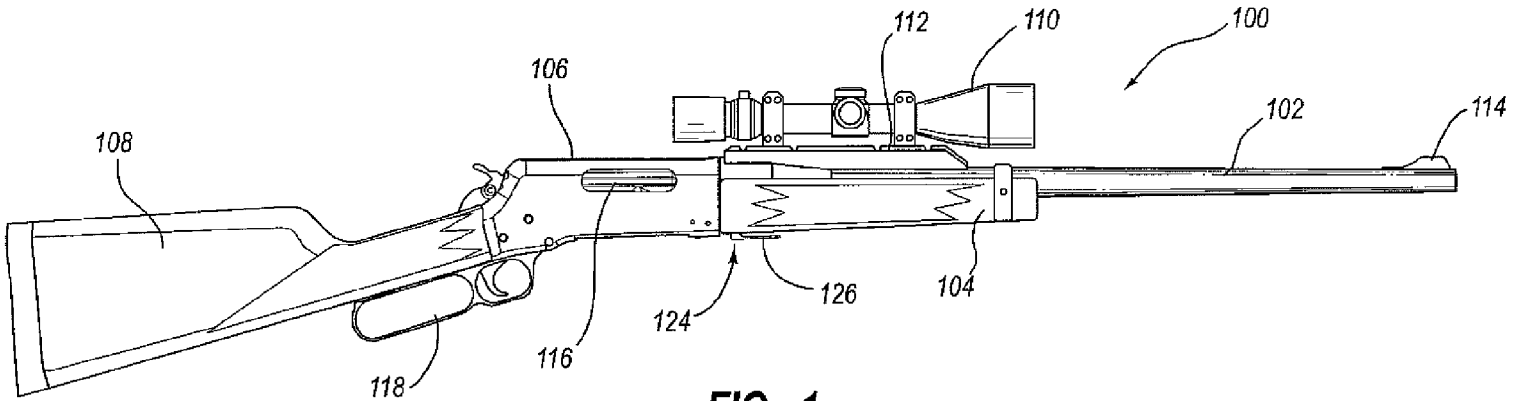
FIG. 1 is a perspective view of one embodiment of a takedown rifle.
Figure 2:
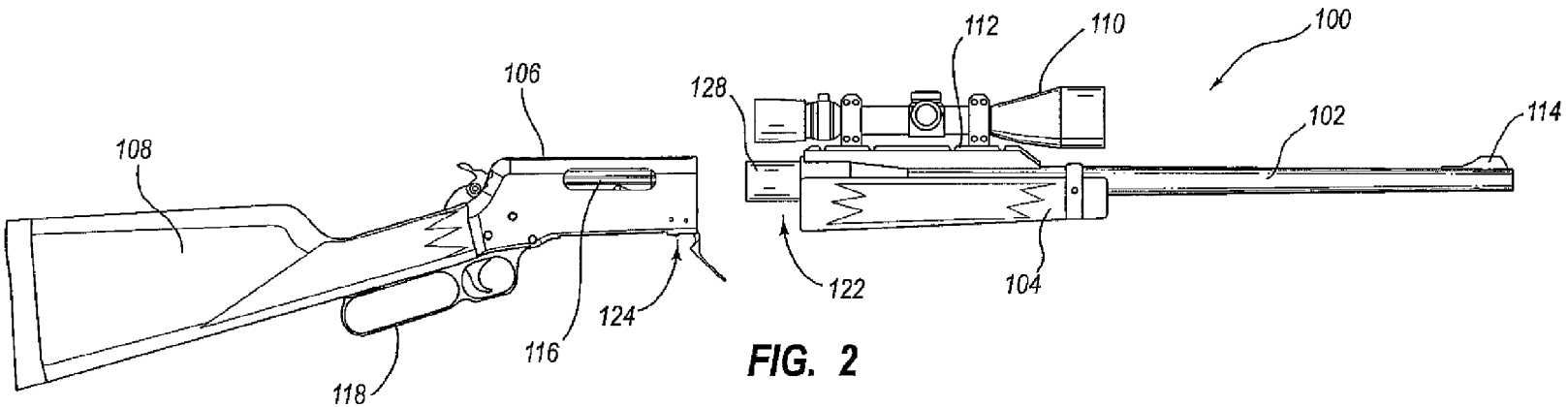
FIG. 2 is a perspective view of the takedown rifle from FIG. 1 separated into two halves or parts.
Figure 3:
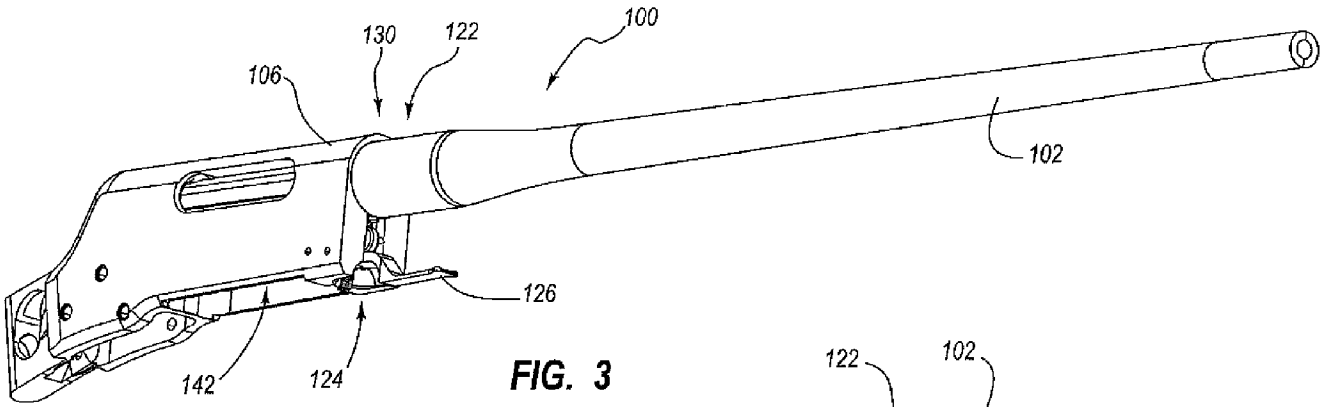
FIG. 3 is a perspective view of the takedown rifle from FIG. 1 with the stock and forearm removed.
Figure 5:
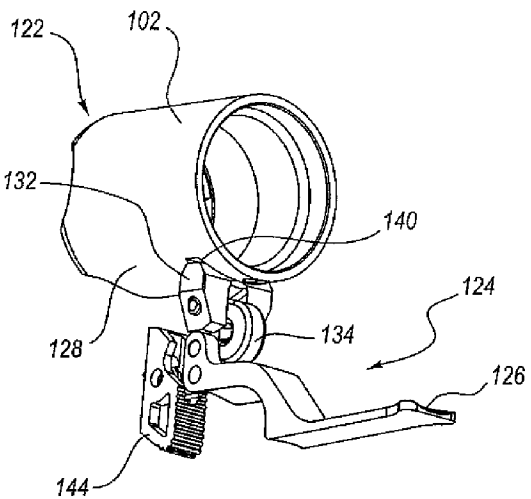
FIG. 5 is a perspective view of the takedown mechanism from FIG. 4 engaged with the barrel to hold the two halves of the takedown rifle together. A magazine release mechanism is also shown.

FIG. 1 shows a perspective view of one embodiment of a takedown rifle 100. The takedown rifle 100 includes a barrel 102 coupled to a forearm 104 and a receiver 106 coupled to a stock 108. The takedown rifle 100 may also fitted with a scope mount 112 and a scope 110 as well as iron sights 114. The scope 110 is shown in FIGS. 1 and 2 coupled to the barrel 102. However, the scope 110 may also be coupled to the receiver 106.

The takedown rifle 100 is designed to be easily separated into two halves or parts to make it easy to transport, clean, store, or otherwise handle the rifle 100. FIG. 2 shows the takedown rifle separated into the two halves. The first half includes the stock 108 and the receiver 106, and the second half includes the barrel 102 and the forearm 104. The takedown rifle 100 is designed to separate where the barrel 102 and the receiver 106 meet.

The takedown rifle 100 also includes a bolt assembly 116 that is operated with a lever 118 to eject a spent cartridge and load the chamber with a fresh cartridge. The bolt assembly 116 includes a rotary bolt that is sized and shaped to lock with lugs 120 positioned at a rearward end 122 of the barrel 102 when the cartridge is chambered. It should be appreciated that the takedown rifle 100 can use other types of bolts as well.

In one embodiment, the barrel 102 of the takedown rifle 100 is interchangeable with other barrels that are different calibers. The bolt may also be configured to handle different calibers of cartridges. For example, the bolt may be capable of chambering, extracting, and ejecting magnum cartridges as well as standard cartridges. The bolt may be capable of chambering short magnums as well as standard magnums. In one embodiment, the bolt may be configured like the bolt described in the Multi-Caliber Bolt Application referred to above and incorporated by reference herein in its entirety.

The takedown rifle 100 includes a takedown mechanism 124 (alternatively referred to herein as a fastening mechanism) that is used to couple the first half (the stock 108 and the receiver 106) and the second half (the barrel 102 and the forearm 104) together. The takedown mechanism 124 pivots from a first position, shown in FIG. 1, where the takedown mechanism holds the first half and the second half of the takedown rifle 100 together to a second position, shown in FIG. 2, where the first half and the second half can be separated from each other.

In one embodiment, the takedown mechanism 124 is a lever mechanism that includes a lever 126, which is positioned parallel to the forearm 104 and the underside of the receiver 106 when the takedown mechanism 124 is in the first position to prevent the lever 126 from catching on things when the takedown rifle 100 is in use. In some embodiments, the lever 126 may be positioned in a recess in the underside of the forearm 104. The takedown mechanism 124 moves to the second position by pivoting the lever 126 outward and away from the underside of the takedown rifle 100. As shown in FIGS. 1 and 2, the lever 126 pivots on an axis that is perpendicular to the lengthwise axis of the takedown rifle 100.

Figure 4:
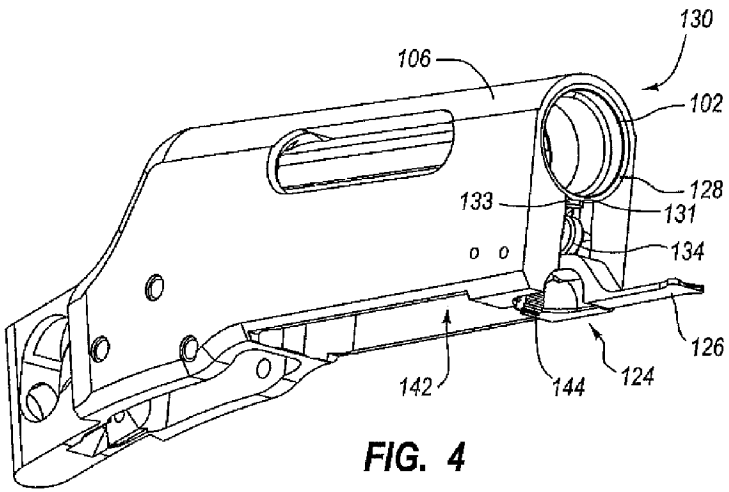
FIG. 4 is a perspective view of the receiver of the takedown rifle from FIG. 1. One embodiment of a takedown mechanism is also shown that may be used to couple the takedown rifle together.
Figure 6:
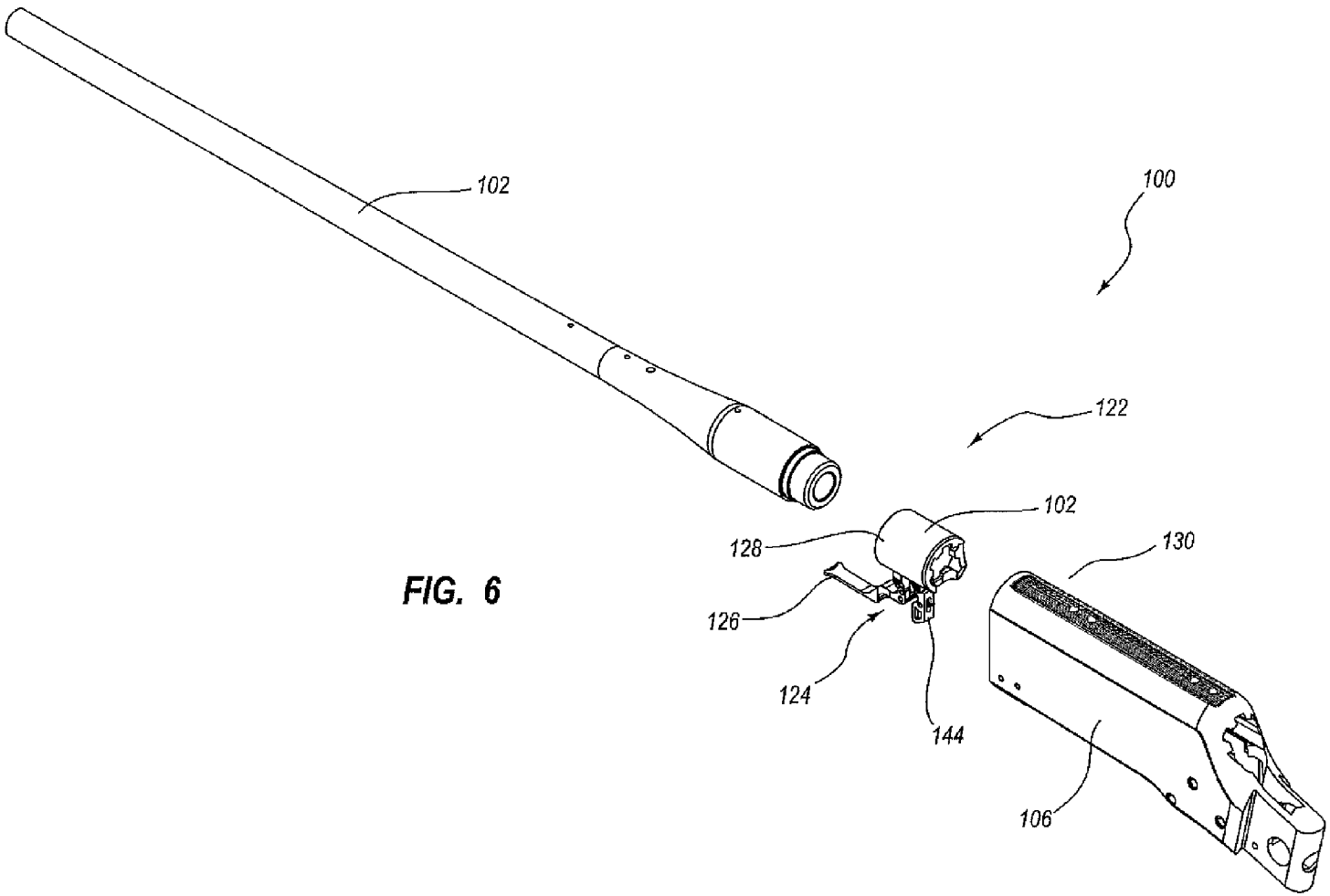
FIG. 6 is a perspective view of the takedown rifle from FIG. 3 with the barrel and receiver separated.
Figure 8:
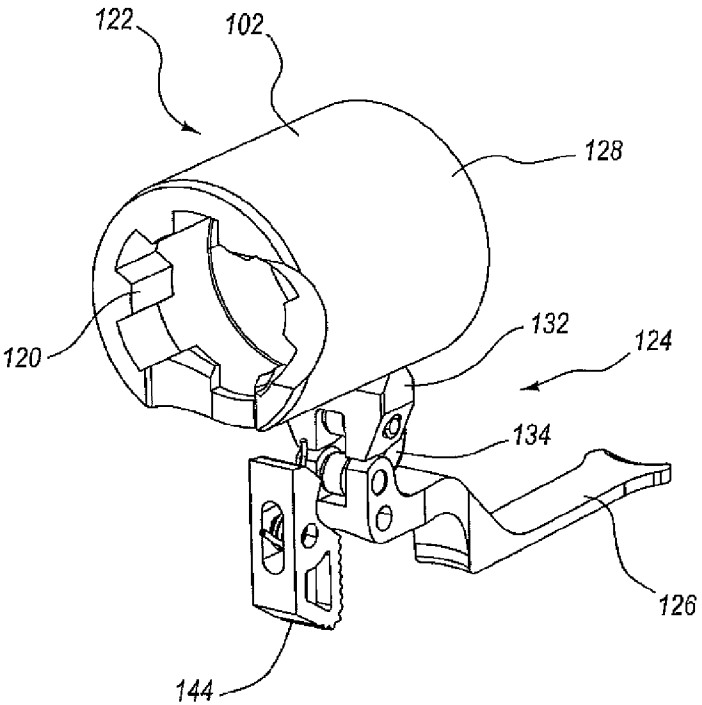
FIGS. 7 and 8 show different perspective views of how the takedown mechanism engages the barrel to hold the takedown rifle together.
Figure 7:
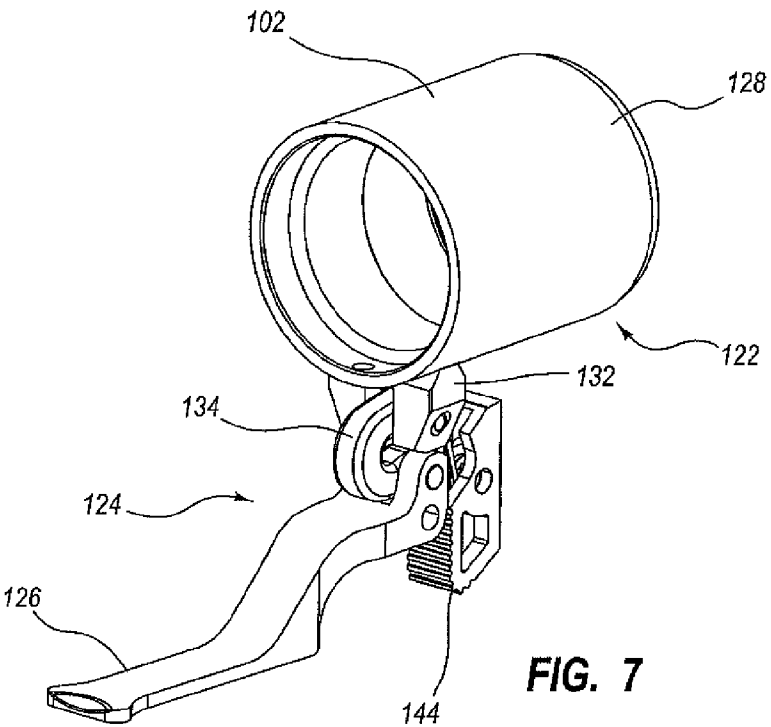

Referring to FIGS. 3-6, the barrel 102 includes a sleeve 128 positioned at the rearward end 122 of the barrel 102. The sleeve 128 is sized to fit in an opening on a forward end 130 of the receiver 106. The sleeve 128 and the corresponding opening in the receiver 106 are both sized to very tight tolerances to create a snug fit and thereby reduce play that might cause the takedown rifle 100 to no longer hold zero. The barrel 102 includes a guide member or post 131 positioned on the underside of the sleeve 128 (FIG. 4). The guide member 131 is sized to snugly fit within a corresponding channel or groove 133 in the bottom of the opening in the receiver 106. The guide member 131 prevents rotational movement of the barrel 102 relative to the receiver 106.

It should be noted that neither the sleeve 128 nor the corresponding opening in the receiver 106 are threaded. Eliminating the interrupted threads that are commonly used with conventional takedown rifles allows the receiver 106 to be made out of lighter weight materials such as aluminum. Reducing the weight of the takedown rifle 100 makes it easier to carry for longer periods of time out in the field.

Figure 9:
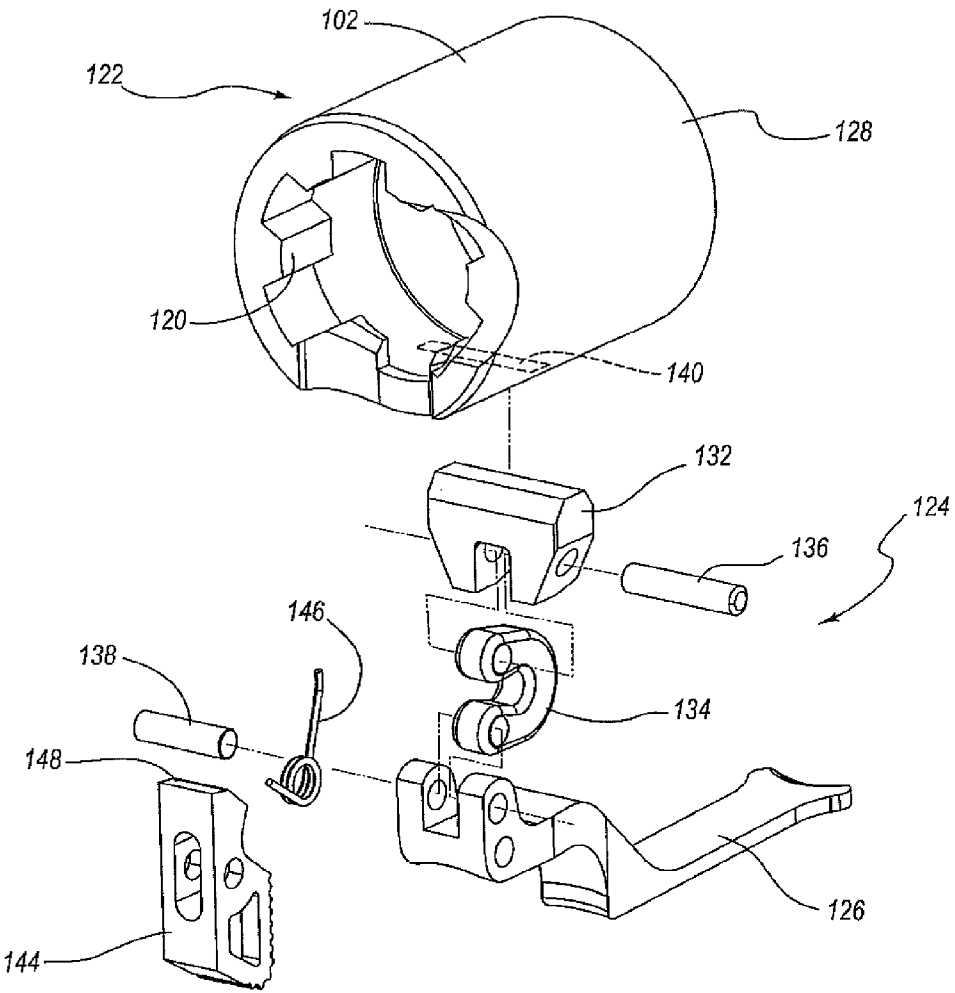
FIG. 9 shows an exploded view of the takedown mechanism and the magazine release mechanism.

Turning to FIG. 9, an exploded view of the takedown mechanism 124 is shown. The takedown mechanism 124 includes a securing member or wedge 132 coupled to a biasing member or link 134, which is in turn coupled to the lever 126. The securing member 132 and the lever 126 are coupled to the biasing member 134 with pins 136, 138 respectively. The biasing member 134 has a U-shape so that when the lever 126 pivots as shown in FIGS. 1 and 2, the biasing member 134 moves the securing member 132 into and out of engagement with the barrel 102. When the takedown mechanism 124 is in the first position, the securing member 132 is wedged into a recess 140 on the underside of the barrel 102, thereby holding the barrel 102 and the receiver 106, and by extension the forearm 104 and the stock 108 together.

In one embodiment, the takedown mechanism 124 may be an over-center lever mechanism. In an over-center lever mechanism, the force necessary to pivot the lever 126 through the full range of motion initially increases as the lever 126 begins to pivot, reaches a maximum at about halfway through the motion, and then lets off substantially until the lever 126 reaches the final resting position. The position and stiffness of the biasing member 134 determines how much force is necessary to pivot the lever 126. In one embodiment, the force needed to move the lever mechanism from the second position (open position) to the first position (the locked closed position) initially increases as the lever 126 begins to pivot toward the forearm 104, reaches a maximum at approximately halfway to the forearm 104, and then decreases until the lever mechanism reaches the first position.

In another embodiment, the takedown mechanism 124 may be operated with a threaded fastener such as a bolt or screw (e.g., an alien bolt or alien screw). In this embodiment, the threaded fastener or member is rotated to selectively move the securing member 132 into and out of the recess 140. It should be appreciated that other alternatives may also be used to operate the takedown mechanism 124

Figure 10:
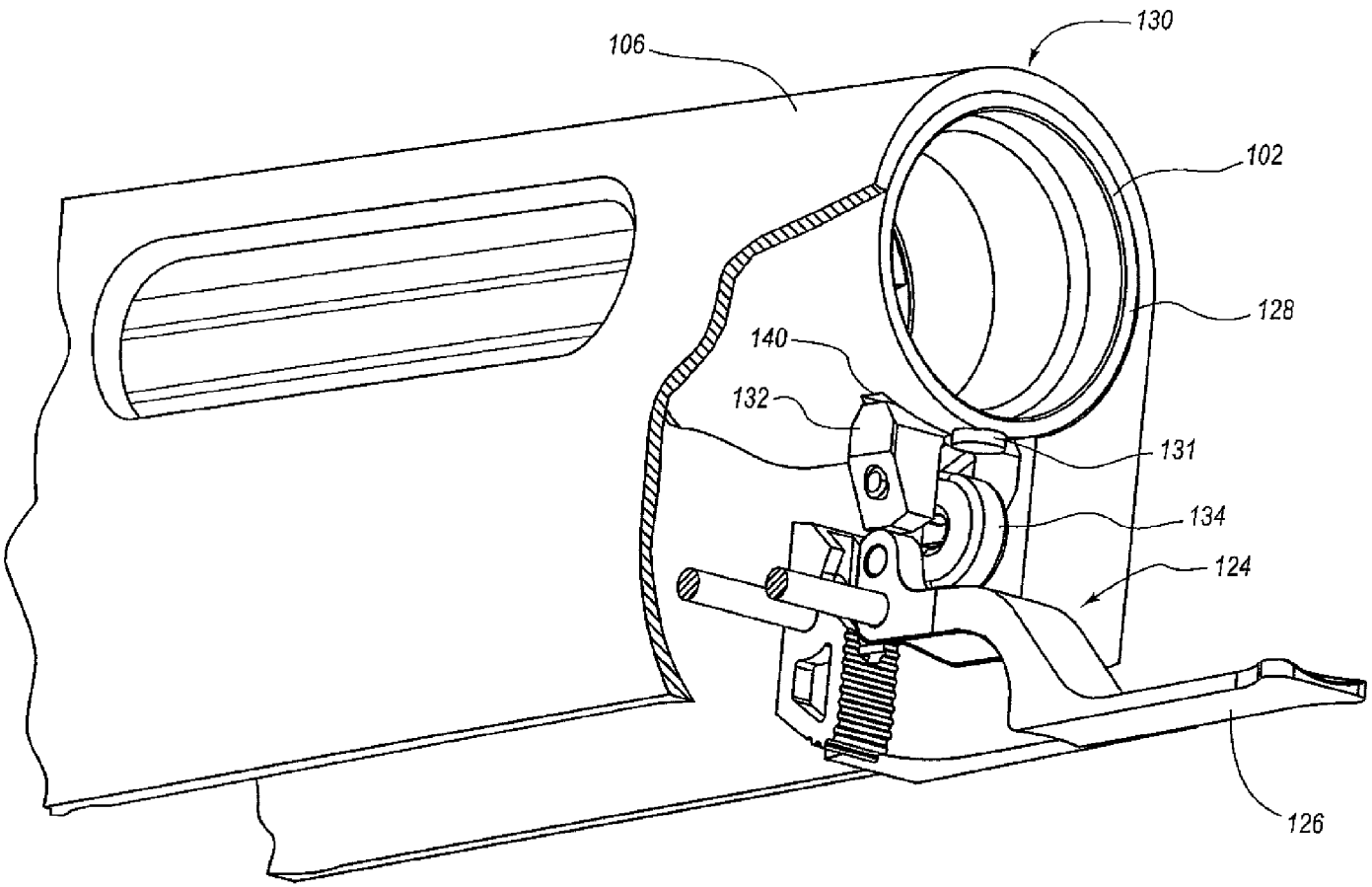
FIG. 10 shows a partially cut-away view of the mechanism and the barrel positioned in the receiver. The takedown mechanism is in a first position where the takedown mechanism holds the barrel and the receiver together.

The process of changing the barrel 102 proceeds as follows. The takedown mechanism 124 is initially moved from a first position (FIG. 10) where the securing member 132 is engaged with the recess 140 in the barrel 102 to a second position where the securing member 132 is retracted away from the barrel 102. The barrel 102 can then be removed from the receiver 106 by pulling the barrel 102 away from the receiver 106. The barrel 102 can be reinstalled by sliding the sleeve 128 into the corresponding opening in the receiver 106 with care to make sure that the guide member 131 on the underside of the barrel 102 slides into the channel 133 in the receiver 106. Once in place, the takedown mechanism 124 is moved from the second position where the two halves of the takedown rifle 100 are not locked together to the first position where the two halves are locked together.

The takedown rifle 100 also includes an opening 142 on the underside of the receiver 106 to receive a box magazine. The magazine is held in place by a magazine latch 144. The magazine latch 144 is biased outward toward the magazine by a spring 146. A top surface 148 (FIG. 9) of the magazine latch 144 rests on the underside of a lip on the magazine thereby holding the magazine in the takedown rifle 100. The magazine can be released by pivoting the magazine latch 144 to disengage the top surface 148 from the lip on the magazine.

Illustrative Embodiments

Reference is made in the following to a number of illustrative embodiments of the subject matter described herein. The following embodiments illustrate only a few selected embodiments that may include the various features, characteristics, and advantages of the subject matter as presently described. Accordingly, the following embodiments should not be considered as being comprehensive of all of the possible embodiments. Also, features and characteristics of one embodiment may and should be interpreted to equally apply to other embodiments or be used in combination with any number of other features from the various embodiments to provide further additional embodiments, which may describe subject matter having a scope that varies (e.g., broader, etc.) from the particular embodiments explained below. Accordingly, any combination of any of the subject matter described herein is contemplated.

According to one embodiment a takedown rifle comprises: a first half that includes a stock coupled to a receiver; a second half that includes a barrel coupled to a forearm; and a takedown mechanism configured to couple the first half and the second half together; wherein the takedown mechanism includes a securing member, the takedown mechanism being configured to move the securing member into a recess in the barrel to hold the first half and the second half together. The takedown rifle may have a lever action. The takedown rifle may have a rotary bolt. The takedown mechanism may be a lever mechanism and the amount of force needed to move the lever mechanism to a locked position where the lever mechanism holds the first half and the second half together initially increases, reaches a maximum, and then decreases until the lever mechanism reaches the locked position. The securing member is a wedge that is forced into the recess in the barrel to hold the first half and the second half together. The barrel and the receiver may not be coupled together with interlocking threads. The receiver may be sized to receive a box magazine. The receiver may be made at least in part of aluminum.

According to another embodiment, a takedown rifle comprises: a first half that includes a stock coupled to a receiver; a second half that includes a barrel coupled to a forearm; and a lever mechanism configured to couple the first half and the second half together, the lever mechanism moving between a first position where the lever mechanism holds the first half and the second half together and a second position where the first half and the second half are not held together; wherein the amount of force needed to move the lever mechanism from the second position to the first position initially increases, reaches a maximum, and then decreases until the lever mechanism reaches the first position. The takedown rifle may have a lever action. The takedown rifle may have a rotary bolt. The lever mechanism may include a securing member that is positioned in a recess in the barrel to hold the first half and the second half together. The barrel and the receiver may be coupled together with interlocking threads. The receiver may be sized to receive a box magazine.

According to another embodiment, a takedown rifle comprises: a stock; a receiver coupled to the stock; a barrel coupled to the receiver with a takedown mechanism; and a forearm coupled to the barrel; wherein the takedown rifle is configured to be separated into two parts by the takedown mechanism, one of the two parts includes the stock and the receiver and the other one of the two parts includes the barrel and the forearm; wherein the takedown mechanism is configured to move between a first position where a securing member is positioned in a recess in the barrel to hold the takedown rifle together and a second position where the securing member is not in the recess to allow the takedown rifle to be separated into the two parts. The takedown rifle may have a lever action. The takedown rifle may have a rotary bolt. The takedown mechanism may be a lever mechanism and the amount of force needed to move the lever mechanism from the second position to the first position initially increases, reaches a maximum, and then decreases until the lever mechanism reaches the first position. The securing member may be a wedge that is forced into the recess in the barrel when the takedown mechanism is in the first position. The barrel and the receiver may not be coupled together with interlocking threads. The receiver may be configured to receive a box magazine.

As used herein, spatial or directional terms, such as "left," "right," "front," "back," and the like, relate to the subject matter as it is shown in the drawing FIGS. However, it is to be understood that the subject matter described herein may assume various alternative orientations and, accordingly, such terms are not to be considered as limiting. Furthermore, as used herein (i.e., in the claims and the specification), articles such as "the," "a," and "an" can connote the singular or plural. Also, as used herein, the word "or" when used without a preceding "either" (or other similar language indicating that "or" is unequivocally meant to be exclusive—e.g., only one of x or y, etc.) shall be interpreted to be inclusive (e.g., "x or y" means one or both x or y). Likewise, as used herein, the term "and/or" shall also be interpreted to be inclusive (e.g., "x and/or y" means one or both x or y). In situations where "and/or" or "or" are used as a conjunction for a group of three or more items, the group should be interpreted to include one item alone, all of the items together, or any combination or number of the items. Moreover, terms used in the specification and claims such as have, having, include, and including should be construed to be synonymous with the terms comprise and comprising.

While this invention has been described with reference to certain specific embodiments and examples, it will be recognized by those skilled in the art that many variations are possible without departing from the scope and spirit of this invention. The invention, as defined by the claims, is intended to cover all changes and modifications of the invention which do not depart from the spirit of the invention. The words "including" and "having," as used in the specification, including the claims, shall have the same meaning as the word "comprising."

What is claimed is:

1. A takedown rifle comprising:

a first half that includes a stock coupled to a receiver;

a second half that includes a barrel coupled to a forearm; and a takedown mechanism configured to couple the first half and the second half together;

wherein the takedown mechanism includes a securing member and a lever mechanism, the lever mechanism being configured to move the securing member radially inward toward a longitudinal axis of the barrel into contact with the barrel along a bottom side of the barrel to hold the first half and the second half together.

2. The takedown rifle of claim 1 wherein the takedown rifle has a lever action.

3. The takedown rifle of claim 1 wherein the takedown rifle comprises a rotary bolt.

4. The takedown rifle of claim 1 wherein an amount of force needed to move the lever mechanism to a locked position where the lever mechanism holds the first half and the second half together initially increases, reaches a maximum, and then decreases until the lever mechanism reaches the locked position.

5. The takedown rifle of claim 1 wherein the securing member is a wedge that is forced into the recess in the barrel to hold the first half and the second half together.

6. The takedown rifle of claim 1 wherein the barrel and the receiver are not coupled together with interlocking threads.

7. The takedown rifle of claim 1 wherein the receiver is sized to receive a box magazine.

8. The takedown rifle of claim 1 wherein the receiver is made at least in part of aluminum.

9. A takedown rifle comprising:

a first half that includes a stock coupled to a receiver;

a second half that includes a barrel coupled to a forearm; and a lever mechanism configured to couple the first half and the second half together, the lever mechanism moving between a first position where the lever mechanism holds the first half and the second half together and a second position where the first half and the second half are not held together;

wherein the amount of force needed to move the lever mechanism from the second position to the first position initially increases, reaches a maximum, and then decreases until the lever mechanism reaches the first position.

10. The takedown rifle of claim 9 wherein the takedown rifle has a lever action.

11. The takedown rifle of claim 9 wherein the takedown rifle comprises a rotary bolt.

12. The takedown rifle of claim 9 wherein the lever mechanism includes a securing member that is positioned in a recess in the barrel to hold the first half and the second half together.

13. The takedown rifle of claim 9 wherein the barrel and the receiver are not coupled together with interlocking threads.

14. The takedown rifle of claim 9 wherein the receiver is sized to receive a box magazine.

15. A takedown rifle comprising:

a stock;

a receiver coupled to the stock;

a barrel coupled to the receiver with a takedown mechanism, the takedown mechanism including a sleeve, a lever, and a securing member, the sleeve being mounted to the receiver and sized to receive an end of the barrel; and a forearm coupled to the barrel;

wherein the takedown rifle is configured to be separated into two parts by the takedown mechanism, one of the two parts includes the stock and the receiver and the other one of the two parts includes the barrel and the forearm;

wherein the takedown mechanism is operable between a first position wherein the securing member is positioned in contact with the barrel to hold the takedown rifle together, and a second position wherein the lever is rotated outward and away from the barrel and the securing member is out of contact with the barrel to allow the takedown rifle to be separated into the two parts.

16. The takedown rifle of claim 15 wherein the takedown rifle has a lever action.

17. The takedown rifle of claim 15 wherein the takedown rifle comprises a rotary bolt.

18. The takedown rifle of claim 15 wherein the takedown mechanism is a lever mechanism and the amount of force needed to move the lever mechanism from the second position to the first position initially increases, reaches a maximum, and then decreases until the lever mechanism reaches the first position.

19. The takedown rifle of claim 15 wherein the securing member is a wedge that is forced into the recess in the barrel when the takedown mechanism is in the first position.

20. The takedown rifle of claim 15 wherein the barrel and the receiver are not coupled together with interlocking threads.

21. The takedown rifle of claim 15 wherein the receiver may be configured to receive a box magazine.

22. The takedown rifle of claim 15 wherein the takedown mechanism includes a lever rotatable about an axis perpendicular to a plane that includes a longitudinal axis of the barrel, the lever mechanism being operable to move the securing member.

23. The takedown rifle of claim 15 wherein the securing member is mounted to an exterior of the sleeve and operable to extend through a recess of the sleeve.

24. A takedown rifle comprising:

a first half that includes a stock coupled to a receiver;

a second half that includes a barrel coupled to a forearm; and a takedown mechanism configured to couple the first half and the second half together;

wherein the takedown mechanism includes a securing member and a lever mechanism, the takedown mechanism being configured to move the securing member into a recess in the barrel to hold the first half and the second half together, and the amount of force needed to move the lever mechanism to a locked position where the lever mechanism holds the first half and the second half together initially increases, reaches a maximum, and then decreases until the lever mechanism reaches the locked position.

25. The takedown rifle of claim 24, wherein the securing member is a wedge that is forced into the recess in the barrel to hold the first half and the second half together.

26. The takedown rifle of claim 24, wherein the receiver is sized to receive a box magazine.

27. The takedown rifle of claim 24 wherein the lever mechanism rotates about an axis perpendicular to a plane that includes a longitudinal axis of the barrel.

28. The takedown rifle of claim 24, wherein the takedown mechanism includes a biasing member operable between the lever mechanism and the securing member.

* * * * *